US006891778B1

(12) United States Patent
Hohenstein et al.

(10) Patent No.: US 6,891,778 B1
(45) Date of Patent: May 10, 2005

(54) WATCH WITH ROTATING CONICAL BANDS AND WITH REMOVABLE OBJECTS

(75) Inventors: William H. Hohenstein, Canton, MA (US); Andrew Von Zodora-Gerlof, New York, NY (US); Ron De Corte, Toledo, OH (US)

(73) Assignee: Zadora Timepieces, LLC, New York, NY (US)

( * ) Notice: Subject to any disclaimer, the term of this patent is extended or adjusted under 35 U.S.C. 154(b) by 155 days.

(21) Appl. No.: 10/031,375

(22) PCT Filed: Jul. 20, 2000

(86) PCT No.: PCT/US00/19728

§ 371 (c)(1),
(2), (4) Date: May 21, 2002

(87) PCT Pub. No.: WO01/05209

PCT Pub. Date: Jan. 25, 2001

Related U.S. Application Data

(60) Provisional application No. 60/144,870, filed on Jul. 20, 1999.

(51) Int. Cl.[7] ..... G04B 19/00; G04B 19/20; G04B 37/00; G04C 21/00

(52) U.S. Cl. ..... 368/76; 368/77; 368/223; 368/234; 368/281; 368/285

(58) Field of Search ..... 368/76, 80, 77, 368/223, 228, 276, 285, 316–317, 234, 281

(56) References Cited

U.S. PATENT DOCUMENTS

| | | | | |
|---|---|---|---|---|
| 2,036,046 | A * | 3/1936 | Harrison | 368/23 |
| 2,444,392 | A | 6/1948 | Willens | |
| 2,513,465 | A * | 7/1950 | Fisk | 368/21 |
| 4,393,558 | A | 7/1983 | Herwegh et al. | |
| 4,525,077 | A | 6/1985 | Ketner | |
| 4,737,943 | A * | 4/1988 | Kienberger | 368/180 |
| 4,817,064 | A | 3/1989 | Milles | |
| 4,858,209 | A * | 8/1989 | Chaut | 368/223 |
| 4,939,913 | A | 7/1990 | Scungio et al. | |
| 4,985,877 | A * | 1/1991 | Namisato | 368/76 |
| 5,412,625 | A | 5/1995 | Duchek | |
| 5,640,372 | A | 6/1997 | Thackara | |
| 5,694,378 | A | 12/1997 | Totsuka | |

FOREIGN PATENT DOCUMENTS

| | | |
|---|---|---|
| CH | 666 979 | 9/1988 |
| DE | 89 13 993 | 2/1990 |
| EP | 0 654 717 | 5/1995 |

* cited by examiner

*Primary Examiner*—Vit W. Miska
(74) *Attorney, Agent, or Firm*—Elmore Craig, PC; Anne I. Craig; Carolyn S. Elmore

(57) ABSTRACT

A timepiece, such as a watch, has a plurality of concentric rotating bands, viewable from both above and from the side so that a viewer may read the time without changing the orientation of the timepiece. The timepiece has an attachment mechanism that permits the removable attachment of objects, such as sculptures or other ornamental pieces to the surface of the timepiece.

3 Claims, 6 Drawing Sheets

WATCH WITH ROTATING CONICAL BANDS AND WITH REMOVABLE OBJECTS

CROSS REFERENCE TO RELATED APPLICATIONS

This application claims priority to U.S. Provisional Application Ser. No. 60/144,870 filed Jul. 20, 1999, the contents of which are herein incorporated by reference in their entirety.

BACKGROUND OF THE INVENTION

1. Field of the Invention

The invention is directed to timepieces, and, more particularly, to timepiecees having rotating conical bands which indicate the time and having removable objects, such as a sculpture or other artwork, on the timepiece.

2. Description of Related Art

Timepieces are well known in the art as are timepieces which can be worn by an individual. Wrist watches, pocket watches, broaches or pendant watches are also known. However, the display of time is typically done using at least hour and minute hands which point, respectively, to the hour of the day and the minute within the hour. Alternatively, digital timepieces are known which display at least hour and minute as numerals, using, for example liquid crystal displays, rather than as pointers to an angular reference to hour and minute.

Existing timepieces have the limitation that they require that the plane of the timepiece face be aligned to be substantially perpendicular with the line of sight of the wearer. In the case of wearable timepieces, this requires that the wearer take some affirmative action to determine the time, such as rotating the wrist so that the orientation of the timepiece face is suitable for reading. This has a disadvantage that a person, with whom one might be meeting, could perceive such an action as impatience or as boredom with the subject of the meeting.

Another problem with the prior art is that the appearance of the watch remains substantially unchanged. This creates some difficulty in fashion coordination, where a user might desire to change the appearance of a timepiece so as to coordinate with a different outfit.

SUMMARY OF THE INVENTION

The problems associated with the prior art are overcome, in accordance with one aspect of the invention, by providing a watch, the time indication of which is represented by rotating bands which can be viewed from both the top and the side to obtain an indication of time.

In accordance with another aspect of the invention, a fixed or rotating platform exists on the top of the timepiece, normally called the bezel, which will support an object, such as any type of sculpture or other aesthetically appealing rendering. Such objects would be removable to permit the sculpture or other rendering to be swapped out with different sculptures or renderings.

The foregoing and other features, aspects and advantages of the present invention will become more apparent from the following detailed description of the present invention when taken in conjunction with the accompanying drawings.

DETAILED DESCRIPTION OF THE INVENTION

Figure 1:
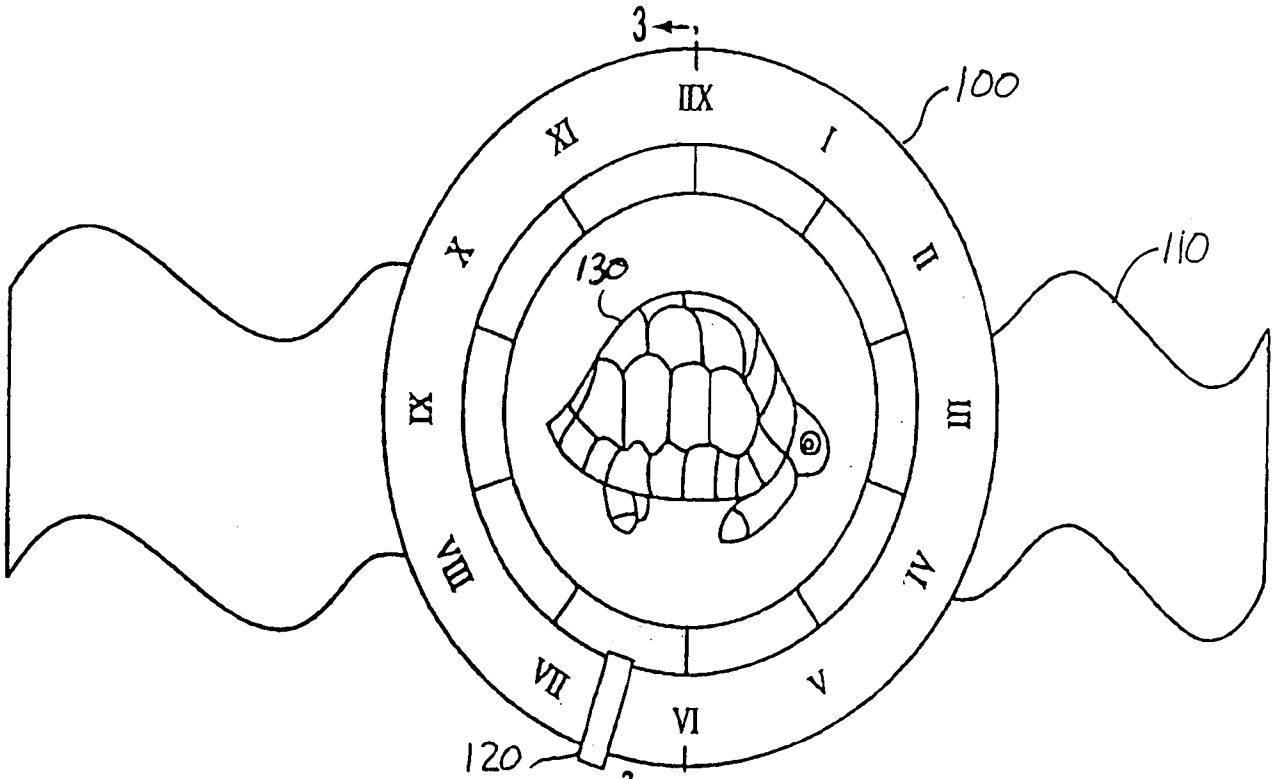
FIG. 1 shows a top view of an exemplary timepiece in accordance with the invention.

FIG. 1 shows a view of an exemplary timepiece, namely a watch, in accordance with the invention. Watch 100 has a watchband 110 and a fixed time indicator 120. A section 3—3 along the centerline of the watch is shown more in detail in FIG. 3. Watch 100 has an object 130 removably attached thereto as described more hereinafter.

Figure 2:
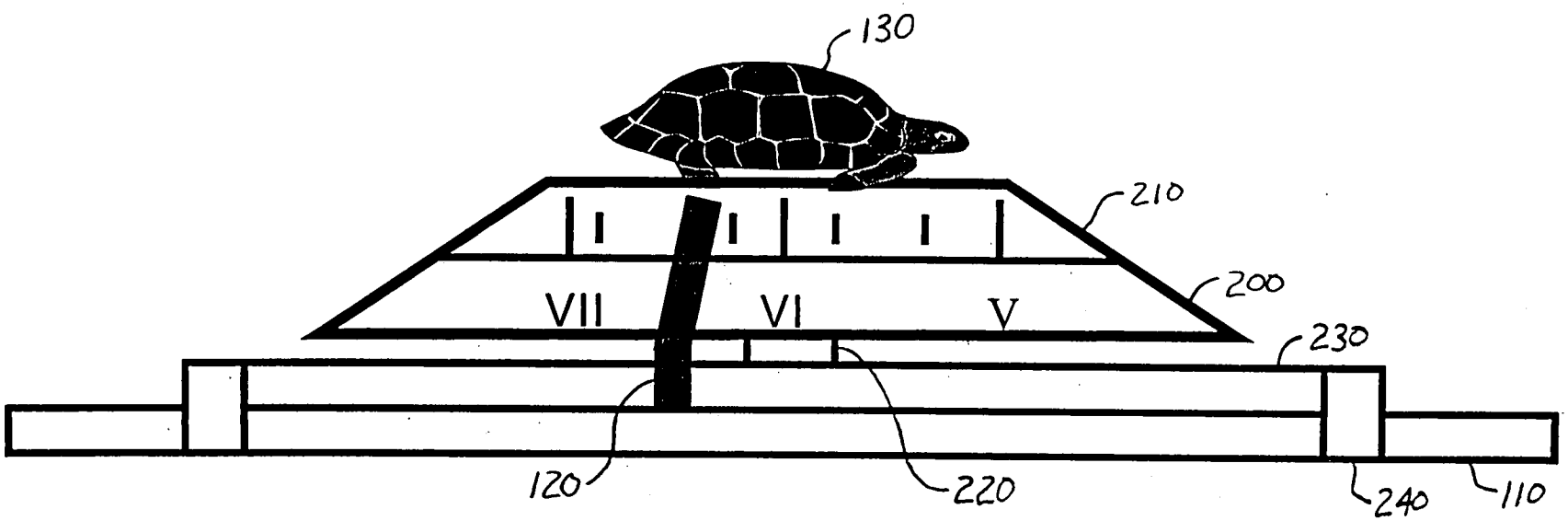
FIG. 2 is a side view of an exemplary timepiece in accordance with the invention.

FIG. 2 is a side view of exemplary watch 100. An object, in this example an ornamental sculpture 130, is removably mounted on the top of the watch. In the illustrated embodiment, the watch has two concentric conical time display bands or rings which rotate about the center of the watch. The bottom one 200, in this example, shows the hour as a location under time indicator 120. The top one 210 shows the minutes. Other bands or rings could be implemented as well. A watch base 230 serves as a mechanical base for the timepiece and permits the connection 240 of a watchband 110.

Figure 3:
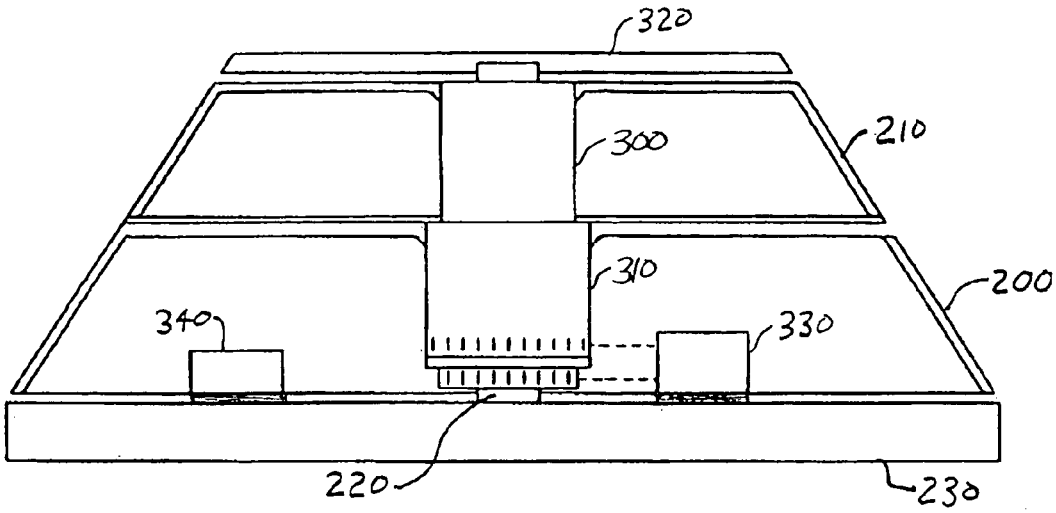
FIG. 3 is a section view of a timepiece along section lines 3—3 of FIG. 1.

FIG. 3 is a section view of watch 100 along section lines 3—3 in FIG. 1. A watch base 230 and platform 320 are mounted together by connection to shaft 220. In this example, the shaft can be press fit or snap fit into the base and into the platform although other techniques for attachment could be used as well. The platform 320 serves as a mounting base for an object such as an ornament or sculpture. The conical time display band or rings 200 and 210 mount to cylinders 310 and 300 respectively, shown in more detail in FIG. 4. One exemplary technique for mounting includes soldering or welding the time display rings to the cylinders. Other techniques may be used as well. Cylinders 300 and 310 are mounted to the shaft 220 concentrically, so as to permit independent rotation, and cylinder 300 fits within cylinder 310. Motor mechanism 330 is coupled to a gear arrangement at the bottom of each cylinder 300 and 310 by one or more gear trains, indicated as dashed lines. A battery 340 may be conveniently mounted to the watch base. The gear train could, of course, be driven by a mechanical drive mechanism of the type used in timepieces for hundreds of years, rather than by an electrical motor.

Figure 4A:
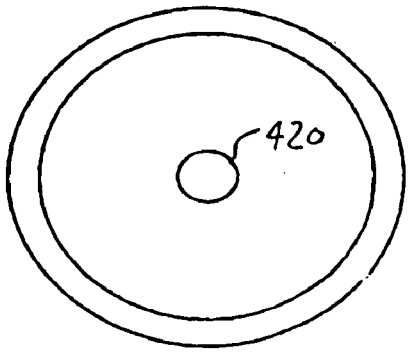
FIGS. 4A, 4B and 4C show top, side and bottom views of drive cylinders used in accordance with one aspect of the invention.
Figure 4B:
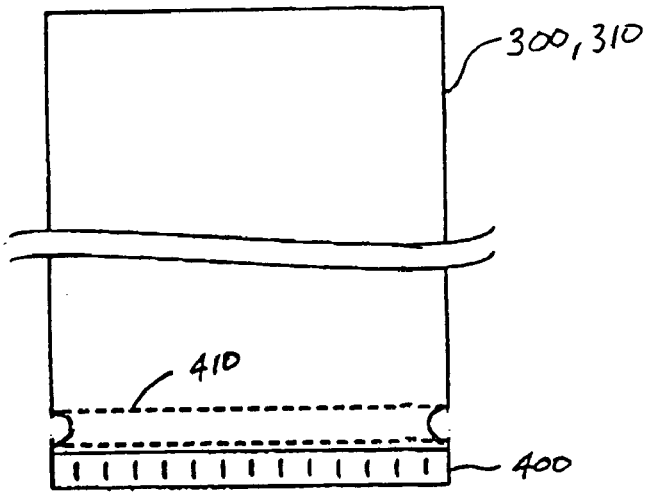
Figure 4C:
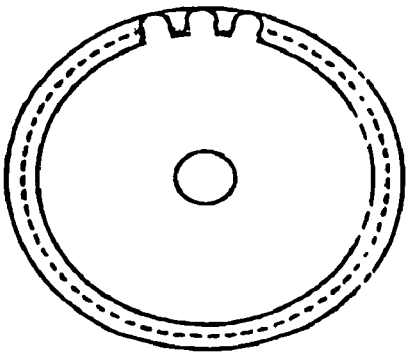

FIGS. 4A, 4B and 4C show exemplary cylinders 300 and 310. A gear or gear teeth are mounted to or formed in the bottom of the cylinder. These engage the gear arrangement driven by the motor. In the implementation of cylinder 300, a notch 410 is provided into which a split C ring may be fitted to keep cylinder 310 from sliding down and interfering with the engagement of the cylinder 300 with the gear arrangement of cylinder 300 driven by the motor.

Figure 5:
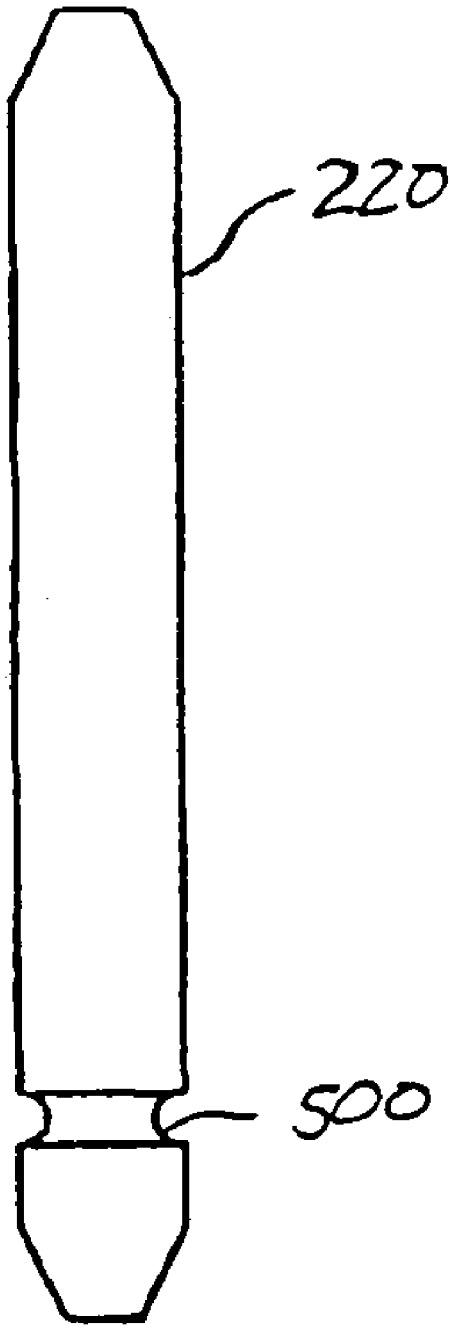
FIG. 5 is an illustration of a shaft to which the cylinders of FIG. 4 might be mounted for operation.

FIG. 5 is an illustration of shaft 220. It too has a notch (500) provided into which a split C ring may be fitted to keep cylinder 300 from sliding down and engaging the watch base which might interfere with the rotation of the cylinder.

Figure 7:
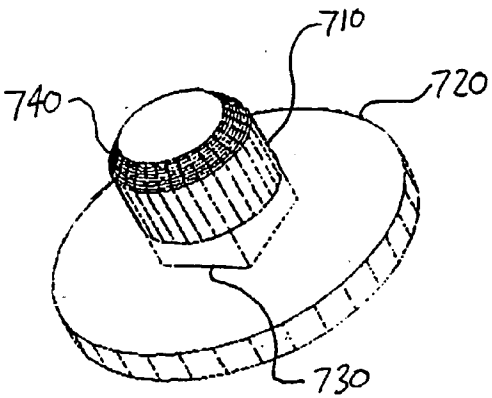
FIG. 7 is a perspective view of an exemplary stud which can be mounted to a timepiece and which mates with the spring of FIG. 6 to hold an object in place.
Figure 6:
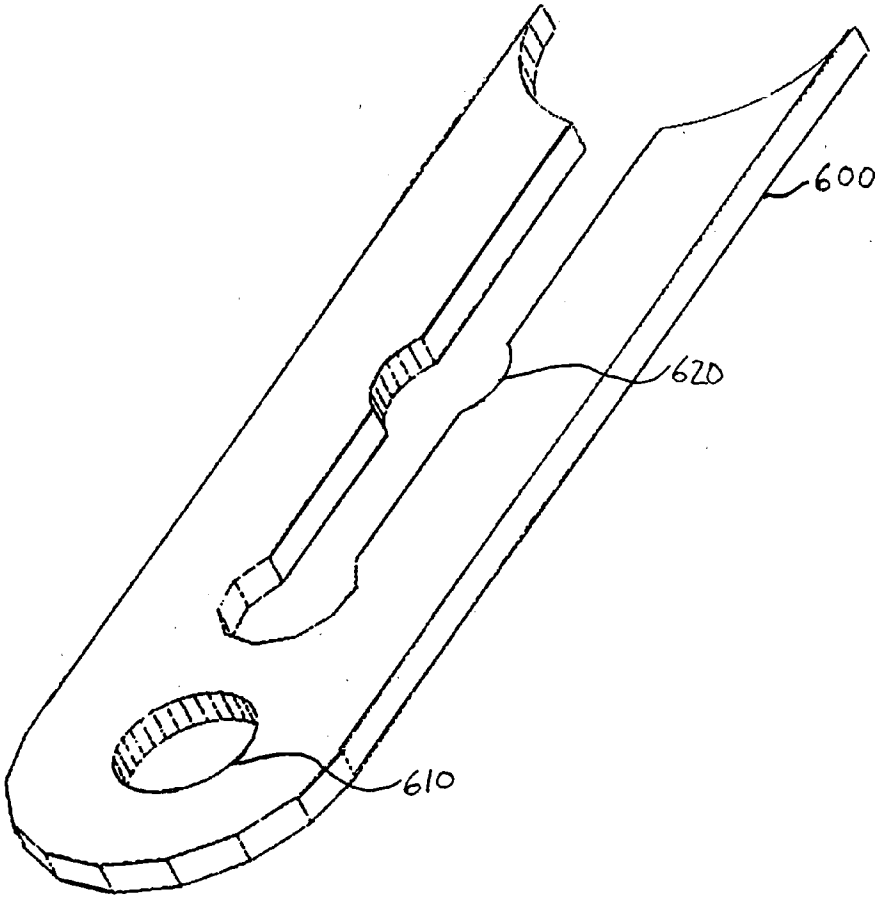
FIG. 6 is an exemplary implementation of a wishbone spring, typically secured to an object that is to be mounted to the timepiece.

The preferred technique for mounting an object to platform 320 is shown in FIGS. 6 and 7. There are two basic parts to this system, a wishbone shaped spring (FIG. 6) and a stud (FIG. 7). In general the spring is secured to the piece that it is to be attached to the watch and the stud is secured to platform 320, preferably at the top and center of the watch.

The wishbone spring 600 is preferably made of spring steel. In an exemplary embodiment, the dimensions of this spring would be approximately 20 mm long, 5 mm wide, and 0.5 mm thick. There is a drilled hole 610 at one end to facilitate a screw for securing to the object to be removably attached. A drilled hole 620 in the middle of the spring, slightly smaller than the pilot diameter of the stud, 710, facilitates easy attachment of the spring mounted object to the stud.

The stud is preferably made of hardened and polished steel. This piece has three distinct features, namely, the base 720 (preferably about 5 mm in diameter), the square 730, and the pilot diameter (each about 2 mm in diameter). The total height from bottom of base to top of the pilot diameter of this part is about 5 mm. The pilot diameter has a tapered end 740 which tapers down from the diameter of pilot diameter to a minor diameter smaller than the size of hole 620 in the wishbone spring.

In this embodiment, it is important that the diameter of the hole 620, in the center of the wishbone spring, be smaller than the diameter of the pilot diameter of the stud. About 25% smaller would be preferable. In this embodiment, it is also important that the apex of the square be the same size as the pilot diameter to facilitate easy removal.

For assembly, a object, such as sculpture 130 is attached to the wishbone spring 600, using, for example, a screw that passes through hole 610 in the spring and into the body of the object.

The wishbone spring is pressed over the tapered (conical) end of the stud and forced open until it opens enough to pass over the pilot diameter until it snaps into place on the square section of the stud. The square section of the stud allows several important advantages. First, the object can be positioned in any 90 degree increment. Second, the object will be easily removed by a simple turn of 45 degrees and lifting away from the watch.

Although the present invention has been described and illustrated in detail, it is clearly understood that the same is by way of illustration and example only and is not to be taken by way of limitation, the spirit and scope of the present invention being limited only by the terms of the appended claims and their equivalents.

What is claimed is:

1. A wristwatch comprising:

(a) a base;

(b) a motor mechanism attached to said base;

(c) a cylindrical, concentric band characterized by time increments; wherein the band surrounds and is rotatably coupled to said motor mechanism and can be viewed from the external sidewall of the band;

(d) a non-rotating and removable platform on the top of said band;

(e) a decorative sculpture attached to said platform; and (f) a watchband.

2. A wristwatch of claim 1 further comprising a second decorative sculpture attached to a platform adapted for attachment on the top of said band.

3. A wristwatch of claim 1 wherein the decorative sculpture can be removed by a turn of 45 degrees and lifting away from the wristwatch.

* * * * *